United States Patent [19]

Moss

[11] 4,340,320

[45] Jul. 20, 1982

[54] DRIVE MECHANISM

[75] Inventor: Robert E. Moss, Yorkville, Ill.

[73] Assignee: Caterpillar Tractor Co., Peoria, Ill.

[21] Appl. No.: 261,231

[22] PCT Filed: Jul. 14, 1980

[86] PCT No.: PCT/US80/00904

§ 371 Date: Jul. 14, 1980

§ 102(e) Date: Jul. 14, 1980

[87] PCT Pub. No.: WO82/00309

PCT Pub. Date: Feb. 4, 1982

[51] Int. Cl.[3] ..... E01C 19/26

[52] U.S. Cl. ..... 404/122; 74/710.5; 74/765; 74/788; 180/20

[58] Field of Search ..... 404/117, 103, 122, 123, 404/124, 125, 126, 129; 74/61, 87, 772, 710.5, 740, 756, 764, 765, 777, 778, 785, 788; 180/20, 242, 305, 308

[56] References Cited

U.S. PATENT DOCUMENTS

| | | | |
|---|---|---|---|
| Re. 27,840 | 12/1973 | Kronholm | 126/123 |
| 1,696,837 | 12/1928 | Christiansen | 74/756 |
| 2,078,161 | 4/1937 | Rietsch | 74/777 X |
| 2,198,397 | 4/1940 | Szekely | 74/777 |
| 3,183,804 | 5/1965 | Letourneau | 404/121 |
| 3,192,839 | 7/1965 | Vivier | 404/117 |
| 3,195,429 | 7/1965 | Cowley | 404/117 |
| 3,225,669 | 12/1965 | Green | 404/117 |
| 3,486,427 | 12/1969 | Waschulewski | 404/117 X |
| 3,741,669 | 6/1973 | Harris | 404/117 |
| 4,108,009 | 8/1978 | Fuchigami | 74/61 |
| 4,186,625 | 2/1980 | Chamberlain | 74/780 |
| 4,201,493 | 5/1980 | Braun | 404/117 |

*Primary Examiner*—Nile G. Byers, Jr.
*Attorney, Agent, or Firm*—William B. Heming

[57] ABSTRACT

A drive mechanism (10) has a frame (16), a driven member (14) and a first element (20) rotatable relative to the frame (18). A driving element (24) is mounted on and rotatable with the first element (20). Apparatus (34), such as a hydraulic motor (40) and pinion gear (38), engages and rotates the driving element (24). Apparatus (36), such as a brake (42) and pinion gear (44) engages and controllably blocks the driving element (24) from rotation. Final drive apparatus (66) transfers rotational motion from the first element (20) to the driven member (14), which can be, for example, a drum (14) of a compactor inside of which the drive mechanism (10) is located. The orientation of the elements of the drive mechanism (10) reduces its width which frees more area inside the space limited drum (14) and eliminates the need to mount components exteriorly to the drum (14) where they can be damaged.

11 Claims, 2 Drawing Figures

DRIVE MECHANISM

TECHNICAL FIELD

The invention relates to a drive mechanism and, more particularly, to a drive mechanism in which the means for driving and means for blocking rotation of the mechanism are oriented perpendicular to the element upon which they act.

BACKGROUND ART

In drive mechanisms it is often desirable to minimize dimensions of the mechanisms in order to make maximum use of space limited mounting locations. For example, a drive mechanism is commonly mounted within a drum or roller of a compactor to rotate the drum. In a vibratory compactor, a vibrating mechanism is also positioned within the drum to impart vibratory forces to the drum. Such a vibratory compactor is illustrated in U.S. Pat. No. 4,108,009 which issued to Fuchigami on Aug. 22, 1978. If both the drive and vibrating mechanisms are utilized, the amount of space within the drum can become very limited. It is not uncommon, therefore, to mount a hydraulic motor, which provides the rotational input to the drive mechanism, outside of the drum. Such a mounting arrangement is shown in U.S. Pat. No. 3,741,669 which issued on June 26, 1973 to Harris. In certain work environments, such a mounting arrangement can subject the exteriorly mounted components to damage from, for example, contacting obstructions in turning the associated vehicle.

Also contributing to the space limitations inside a drum is the problem of obtaining the most desirable final rotational speed of the drum relative to the input of the motor. This sometimes can require numerous sets of gears in the drive mechanism to change the speed of the rotational input. Use of a plurality of gear sets to change speeds particularly affects the width of a drive mechanism which can further limit the space available inside the drum for mounting the vibratory drive mechanism.

The present invention is directed to overcoming one or more of the problems as set forth above.

DISCLOSURE OF INVENTION

In one aspect of the present invention, apparatus includes a frame, a driven member, and a first element rotatable relative to the frame. A driving element is mounted on and rotatable with the first element about an axis of rotation of said first element. Means are provided for engaging and rotating the driving element and for engaging and blocking from rotation said driving element. Said means each define an axis of rotation oriented at a location perpendicular to the axis of rotation of the first element. Final drive means is provided for transferring rotational motion from the first element to the driven member.

The apparatus is used, for example, within a drum of a vibratory compactor for rotating the drum. The orientation of the engaging and rotating means and the engaging and blocking means reduces the width of the apparatus to provide more space within the drum for other components and to eliminate the necessity of mounting elements outside the drum where they could be damaged.

BEST MODE FOR CARRYING OUT THE INVENTION

Figure 1:
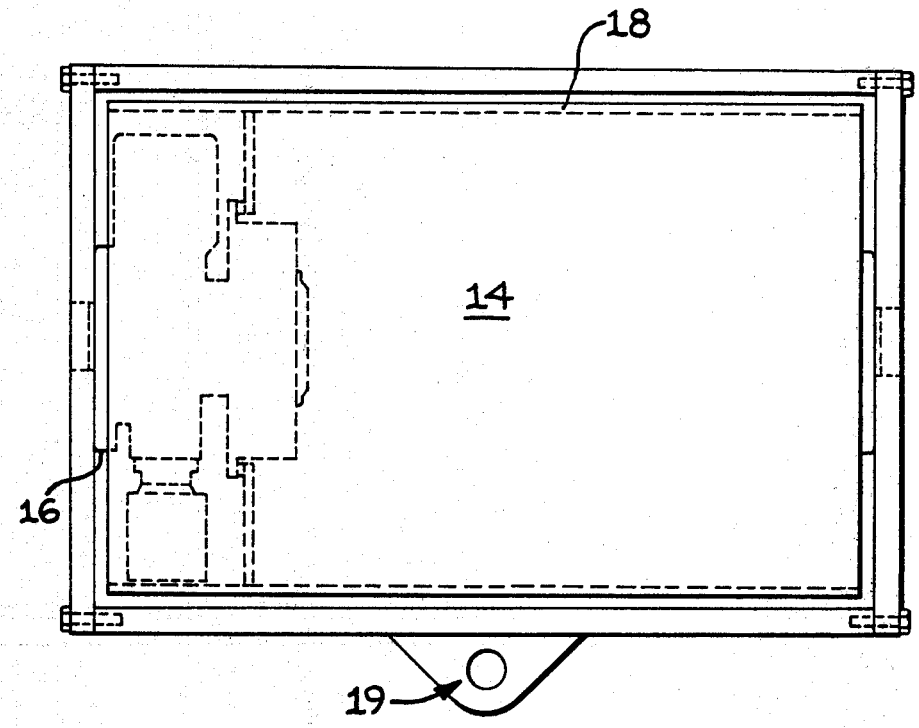
FIG. 1 is a diagrammatic view in elevation showing a vibratory compactor, such as is pulled by a vehicle, incorporating one embodiment of the present invention.
Figure 2:
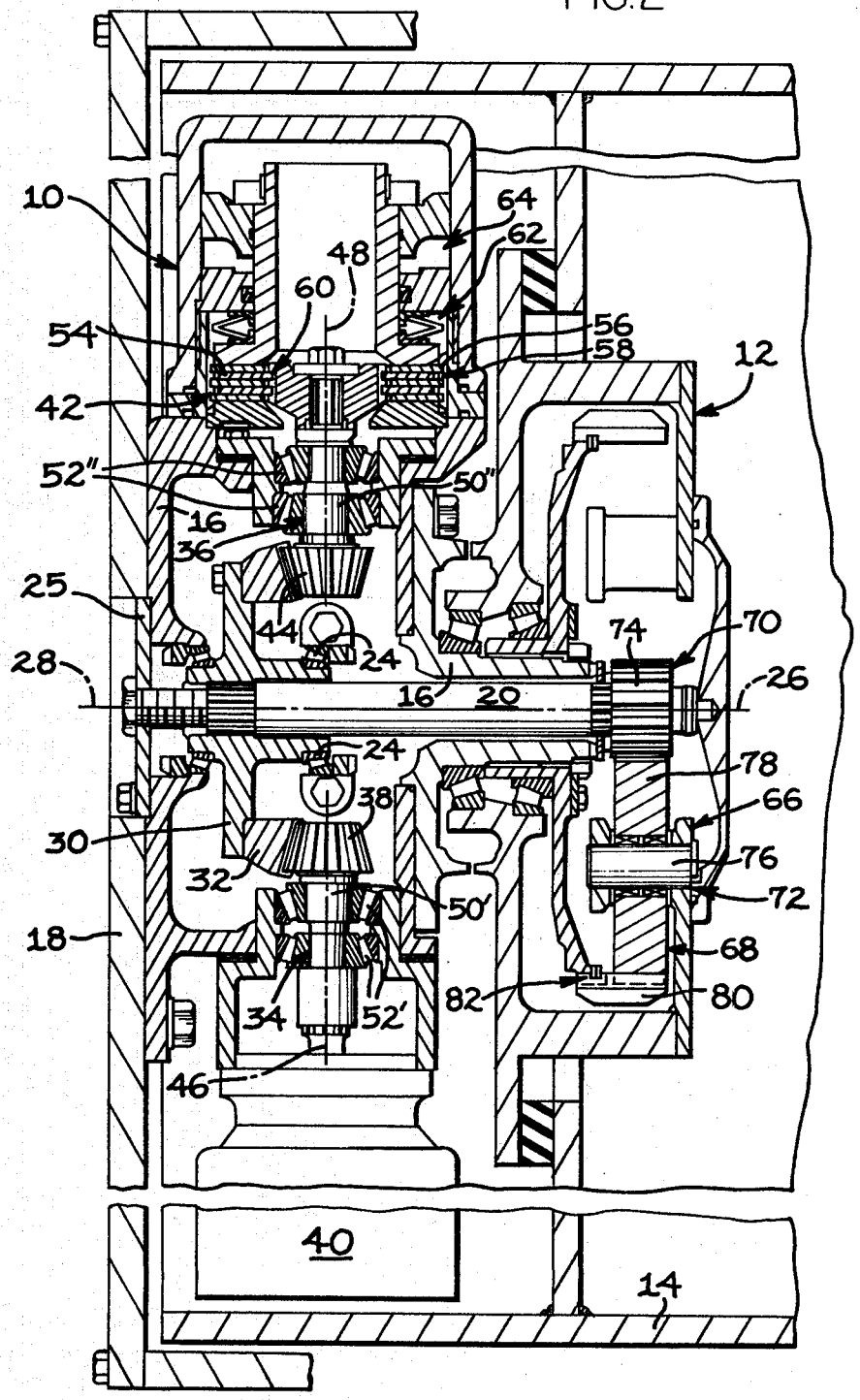
FIG. 2 is a diagrammatic, cross-sectional view in partial elevation of a portion of the compactor and showing the present invention.

Referring to the drawing, apparatus 10 is shown, for example, associated with a vibratory compactor 12 which includes a driven member or drum 14 and a yoke 16 which is a portion of a frame 18. The apparatus is a right angle drive mechanism which receives a power input from an associated vehicle (not shown) and subsequently drives the drum at a desired rotational speed. The compactor is connected to the vehicle by the frame at a pivot point 19. Also positioned in the drum adjacent the drive mechanism is a vibratory mechanism (not shown) which receives a power input from the vehicle and typically creates an unbalanced rotational output for establishing vibratory forces on the drum. Vibratory compactors are well known in the compacting art and are commonly used in land fill or construction operations which require compacting the earth, fill material or road surfacing material to specific densities.

The drive mechanism 10 has a first element or shaft 20 rotatable relative to the yoke 16 on bearings 24 and accessible through removal of a plate 25. The shaft is rotatable about its axis of rotation 26 which is substantially the same as the centerline or axis of rotation 28 of the drum about which the frame 18 connects to said drum. Mounted on the shaft through splines is a driving element 30 directly supported by the bearings 24 and shown including a bevel gear 32, which is rotatable with the shaft about its axis of rotation. First means 34 is provided for engaging and rotating the driving element and second means 36 is provided for engaging and controllably blocking from rotation, or braking the rotation of, the driving element. The first means includes a first pinion gear 38 positioned in engagement with the bevel gear power means 40, such as a hydraulic motor. The second means includes a brake 42 and a second pinion gear 44 rotationally associated with the brake and positioned in engagement with the bevel gear. Each of said means defines an axis of rotation 46,48 oriented perpendicular to the axis of rotation 26 of the shaft. Preferably, and as is shown, said axes are substantially the same such that the pinion gears drive the shaft on opposite sides of the shaft.

Referring specifically to the configuration of the pinion gears 38,44 and their associated elements, each of the pinion gears includes a shaft portion 50',50'' having the related axis of rotation 46,48 and being rotatably supported on the yoke 16 by bearings 52',52''. The shaft portion 50' of the first pinion gear 38 extends toward and is rotatably connected to the hydraulic motor 40 by a coupling. The shaft portion 50'' of the second pinion gear 44 extends to the brake 42 which has a friction 54 and a reaction 56 disc (shown as a plurality). One set of said discs, shown as the reaction discs, is fixed from rotation relative to the frame through a splined connection 58 with the frame. The other set of said discs, shown as the friction discs, is rotatable with the second pinion gear also through a splined connection 60. The discs are normally frictionally engaged one with the other owing to the biasing force of frusto-conical washers 62. A piston assembly 64 is hydraulically actuatable to controllably release the brake by overcoming the force of the washers. Such brake operation is well known, particularly in the work vehicle art.

Acting at the opposite end of the shaft 20, final drive means 66 transfers rotational motion from the shaft to the drum 14 in order to drive the drum. The final drive means, shown as a planetary gear assembly 68, includes first and second motion transfer elements 70,72 having a preselected drive ratio relationship one relative to the other. The first transfer element, a sun element 74 of the planetary gear assembly shown carried on the shaft, is rotatable with said shaft. The second transfer element, shown as a carrier element 76 of the planetary gear assembly, is rotatable with the drum owing to its connection with said drum. The planetary gear assembly also includes a planet element 78 and a ring element 80 which is fixed from rotation relative to the yoke 16 through a splined connection 82. It should be understood that the ring element can also be connected to the drum with the carrier element fixed relative to the frame. Such planetary gear assemblies are well known in the art and are commonly used for providing a speed reducing or increasing function on a drive mechanism through the drive ratio established by the relationship of the teeth on the sun, planet and ring elements.

INDUSTRIAL APPLICABILITY

In the use of the drive mechanism 10, the brake discs 54,56 are released from frictional engagement by actuating the piston assembly 64 and the hydraulic motor 40 is actuated to rotate the first pinion gear 38 and drive the shaft 20 through the bevel gear 32. The rotating shaft causes the sun element 74 to rotate which results in driving the drum 14 with the rotating carrier element 76. The ratio of the bevel 32 and pinion 38,44 gears and the elements 74,78,80 of the planetary gear assembly 68 establish the rotational output speed of the carrier, and thus the rotational speed of the drum, relative to the rotational speed of the hydraulic motor.

Where desired, the drum 14 can be slowed or entirely braked by frictionally engaging the friction and reaction discs 54,56 of the brake 42. This is accomplished by decreasing or eliminating the fluid pressure in the piston assembly 64 acting to overcome the biasing force of the frusto-conical washers 62 which, during operation, is usually maintained at sufficient magnitude to overcome the biasing force of the washers that otherwise acts to move the discs into frictional engagement.

As will be seen from the drawing, the drive mechanism 10 presents a compact and space efficient apparatus owing to its "right angle" drive arrangement derived from the relationship of the bevel 32 and pinion 38,44 gears. The shaft 20, bevel gear, pinion gears, hydraulic motor 40, brake 42 and planetary gear assembly 68 are all located within the drum 14. This eliminates the need to position elements externally of the drum, such as on the frame 18, where they might be damaged in the work environment. The width of the drive mechanism is reduced owing to the "right angle" arrangement of the motor 40 and brake 42 and the use of the single planetary gear assembly 68 for the final drive. This results in additional space within the drum for mounting the vibration mechanism which imparts the vibratory forces to the drum. Further, removal of the plate 25, allows removal of the shaft 20 from its splined connections to permit towing of the compactor 12 without damage to the motors therein if a breakdown does occur.

Other aspects, objects and advantages will become apparent from a study of the specification, drawings and appended claims.

I claim:

1. Apparatus (10), comprising:

a frame (18) including a yoke (16);

a compacting drum (14) having an axis of rotation (28) and being rotatably mounted on said yoke (16);

a first element (20) having an axis of rotation (26) and being associated with and rotatable relative to said frame (18) within said compacting drum (14), said axis of rotation (26) of said first element (20) being substantially the same as said axis of rotation (28) of said compacting drum (14);

a driving element (30) mounted on and rotatable with said first element (20) about said axis of rotation (26) of said first element (20) within said compacting drum (14);

means (34) for engaging and rotating said driving element (30), said means (34) defining an axis of rotation (46) oriented perpendicular to said axis of rotation (26) of said first element (20) and being positioned within said compacting drum (14) and carried by said frame (18);

means (36) for engaging and controllably blocking from rotation said driving element (30), said means (36) defining an axis of rotation (48) oriented perpendicular to said axis of rotation (26) of said first element (20) and being positioned within said compacting drum (14) and carried by said frame (18); and final drive means (66) for receiving rotational motion from said first element (20) and rotatably driving said compacting drum (14) in response to said rotational motion, said final drive means (66) having a preselected drive ratio and being positioned within said compacting drum (14).

2. The apparatus (10), as set forth in claim 1, wherein said driving element (30) includes a bevel gear (32) and said engaging and rotating means (34) includes a pinion gear (38) having said axis of rotation (46) of said engaging and rotating means (34) and being positioned in engagement with said bevel gear (32).

3. The apparatus (10), as set forth in claim 1, wherein said driving element (30) includes a bevel gear (32) and said engaging and blocking means (34) includes a brake (42) and a pinion gear (44), said pinion gear (44) having said axis of rotation (48) of said engaging and blocking means (34) and being rotatably associated with said brake (42) and positioned in engagement with said bevel gear (32).

4. The apparatus (10), as set forth in claim 3, wherein said brake (42) includes a friction (54) and a reaction (56) disc, one of said friction and reaction discs (54,56) being fixed from rotation relative to said frame (18), the other of said friction and reaction discs (54,56) being rotatable with said pinion gear (44).

5. The apparatus (10), as set forth in claim 1, wherein said final drive means (66) is a planetary gear assembly (68) having planet (78), ring (80), sun (74) and carrier (76) elements and said sun element (74) is rotatably carried on said first element (20) and one of said carrier (76) and ring (80) elements is rotatable with said compacting drum (14).

6. The apparatus (10), as set forth in claim 1, wherein said driving element (30) includes a bevel gear (32), said engaging and rotating means (34) includes a pinion gear (38) and power means (40) for rotating said pinion gear

(38) and said engaging and blocking means (36) includes a pinion gear (44) and a brake (42), said pinion gear (38) of said engaging and rotating means (34) having said axis of rotation (46) of said engaging and rotating means (34) and being positioned in engagement with said bevel gear (32), said pinion gear (44) of said engaging and blocking means (36) having said axis of rotation (48) of said engaging and blocking means (36) and being positioned in engagement with said bevel gear (32) and rotatably associated with said brake (42), said axes of rotation (46,48) of said engaging and rotating means (34) and of said engaging and blocking means (36) being substantially the same.

7. The apparatus (10), as set forth in claim 6, wherein said final drive means (66) is a planetary gear assembly (68) having sun (74), ring (80) and carrier (76) elements, said sun element (74) being rotatably carried on said first element (20), one of said ring (80) and carrier (76) elements being connected to said compacting drum (14), the other of said ring (80) and carrier (76) elements being rotatably fixed relative to said frame (18).

8. Apparatus (10), comprising:

a frame (18);

a driven member (14) having an axis of rotation (28);

a first element (20) having an axis of rotation (26) and being carried by and rotatable relative to said frame (18), said axis of rotation (26) of said first element (20) being substantially the same as said axis of rotation (28) of said driven member (14);

a bevel gear (32) mounted on and rotatable with said first element (20) about said axis of rotation (26) of said first element (20);

means (34) for engaging and rotating said bevel gear (32), said means (34) including a pinion gear (38) and being carried by said frame (18), said pinion gear (38) defining an axis of rotation (46) oriented perpendicular to said axis of rotation (26) of said first element (20) and being positioned in engagement with said bevel gear (32);

means (36) for engaging and controllably blocking from rotation said bevel gear (32), said means (36) including a different pinion gear (44) and being carried by said frame (18), said pinion gear (38) defining an axis of rotation (48) oriented perpendicular to said axis of rotation (26) of said first element (20) and positioned in engagement with said bevel gear (32); and final drive means (66) for receiving rotational motion from said first element (20) and rotatably driving said driven member (14) in response to said rotational motion, said final drive means (66) having a preselected drive ratio.

9. The apparatus (10), as set forth in claim 8, including a brake (42) having a friction (54) and a reaction (56) disc and being positioned within said driven member (14), one of said friction and reaction discs (54,56) being fixed from rotation relative to said frame (18), the other of said friction and reaction discs (54,56) being rotatable with said pinion gear (44).

10. The apparatus (10), as set forth in claim 8, wherein said final drive means (66) is a planetary gear assembly (68) having sun (74), ring (80), planet (78) and carrier (76) elements, said sun element (74) being carried by and rotatable with said first element (20), one of said ring (80) and carrier (76) elements being rotatable with said driven member (14), the other of said ring (80) and carrier (76) elements being rotatably fixed relative to said frame (18).

11. The apparatus (10), as set forth in claim 9, wherein said engaging and rotating means (34) includes a motor (40) for rotating said related pinion gear (38), and said pinion gears (38,44), said brake (42), said motor (40) and said final drive means (66) are positioned within said driven member (14).

* * * * *